United States Patent [19]

Gerstenberger

[11] Patent Number: 4,542,859

[45] Date of Patent: Sep. 24, 1985

[54] METHOD AND APPARATUS FOR ROLLING MATS

[76] Inventor: Roland W. Gerstenberger, 5 Chipmunk Rd., Asheville, N.C. 28804

[21] Appl. No.: 497,110

[22] Filed: May 23, 1983

[51] Int. Cl.[4] ..... B65H 17/12

[52] U.S. Cl. ..... 242/67.2; 242/DIG. 3

[58] Field of Search ..... 242/55.1, DIG. 3, 67.1 R, 242/67.2; 72/146

[56] References Cited

U.S. PATENT DOCUMENTS

| | | | |
|---|---|---|---|
| 1,403,246 | 1/1922 | Hildebrandt | 242/55.1 X |
| 1,462,411 | 7/1923 | Johnson | 72/146 |
| 1,662,577 | 3/1928 | Johnson | 242/55.1 |
| 2,231,400 | 2/1941 | Washburn et al. | 72/146 |
| 2,880,943 | 4/1959 | Stephens | 242/67.1 R |
| 3,474,980 | 10/1969 | Mann, Jr. | 72/146 X |
| 3,622,098 | 11/1971 | Nelson | 242/67.1 R |
| 3,850,381 | 11/1974 | Moore | 242/67.1 R X |
| 4,344,585 | 8/1982 | Eglinton | 242/DIG. 3 X |

*Primary Examiner*—Stuart S. Levy
*Assistant Examiner*—Lloyd D. Doigan
*Attorney, Agent, or Firm*—David M. Carter

[57] ABSTRACT

A method and apparatus is provided for tightly rolling mats. The mats are moved in a horizontal direction in their flattened condition to a rolling section which includes a plurality of fixed curved fingers and a corresponding plurality of curved spring-loaded fingers. A roller is further provided to move the mat upwardly from the conveyor forming a tight cylindrically shaped mat inside the curve of the fingers. Upper belts are provided above the fingers to further ensure that the mat is rolled tightly.

5 Claims, 2 Drawing Figures

METHOD AND APPARATUS FOR ROLLING MATS

BACKGROUND OF THE INVENTION

This invention relates to a method and apparatus for rolling flat flexible work pieces. More particularly, it relates to a method and apparatus for ensuring that flat, flexible workpieces are rolled very tightly.

Laundries which are in the mat cleaning business have found it necessary to roll the mats after they have been cleaned because of customer demand, space limitations and ease in handling. Early on the mats were simply rolled by hand with the resulting high labor cost. Recently machines have been developed to roll mats. However, these machines have a major drawback in that to data no machine has been developed which will roll a mat into an acceptable tight roll. Obviously, the tighter the roll the easier the mat is to handle and the less space it takes up in storage and during transport.

OBJECTS OF THE INVENTION

It is therefore one object of this invention to provide a method and apparatus for rolling a flat, flexible workpiece into a tight roll.

It is another object to provide an apparatus which efficiently and economically rolls mats into a tight bundle.

It is still another object to provide an apparatus which will roll various sizes of mats.

SUMMARY OF THE INVENTION

In accordance with one form of this invention there is provided a method and apparatus for rolling a flat, flexible workpiece. A conveyor section and a rolling section are included in the apparatus, with the rolling section having a lower portion. The conveyor section transports the workpiece in its flattened condition to the rolling section. The lower portion of the rolling section includes at least one curved finger having a feed-in and feed-out portion located on its opposing ends. The feed-in portion is located adjacent one end of the conveyor section and receives the workpiece from the conveyor section. A roller drive is situated between the feed-in and feed-out portions of the curved finger. The rolling drive contacts the workpiece to drive it along the curved finger for forming the flat workpiece into a rolled workpiece.

Another aspect of the invention includes an upper portion of the rolling section having second fingers detached from the first fingers but forming approximately a continuation of the arc of the first fingers. The second fingers are biased inwardly to ensure a tight roll, yet will move as the circumference of the roll increases during the operation of the apparatus.

Another aspect of the invention includes a transport member contacting the portion of the workpiece located between the first and second fingers for further enhancing the tightness of the roll.

BRIEF DESCRIPTION OF THE DRAWINGS

The subject matter which is regarded as the invention is set forth in the appended claims. The invention itself however together with further objects and advantages thereof can be better understood by reference to the following description taken in conjunction with the accompanying drawings in which:

DESCRIPTION OF THE PREFERRED EMBODIMENT

Figure 1:
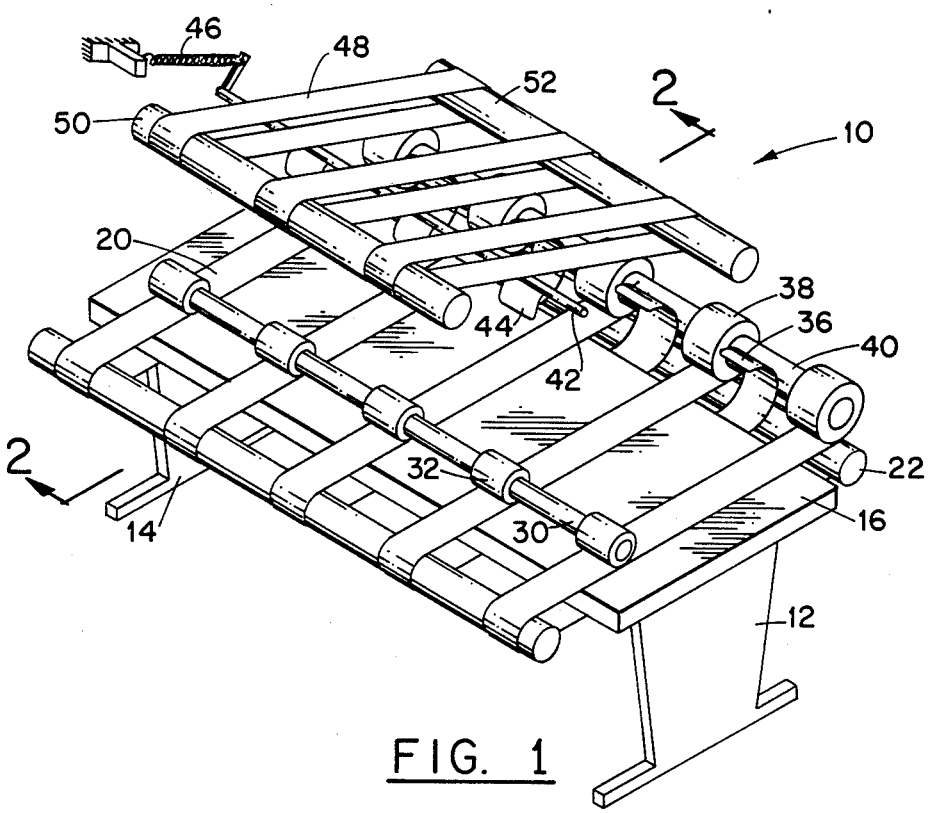
FIG. 1 is a pictorial view of the apparatus of the subject invention with portions removed for purposes of clarity.
Figure 2:
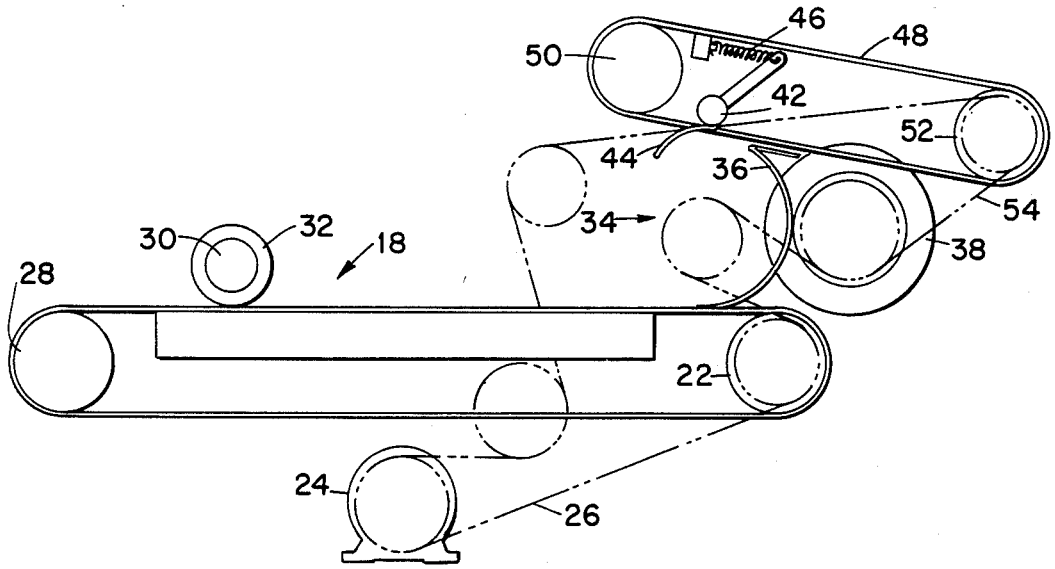
FIG. 2 is a side elevational view of portions of the apparatus of FIG. 1 taken through section lines 2—2.

Referring now more particularly to FIG. 1, there is shown a pictorial view of mat rolling machine 10 supported by legs 12 and 14. The legs are connected to platform 16 which, in turn, supports the operational mechanism of the rolling machine. The operational parts of the rolling machine may be better understood with reference to FIG. 2, which is a sectional view of FIG. 1 taken along line 2—2.

Conveyor section 18 includes a plurality of belts 20 which are driven by drive roller 22. Drive roller 22 is, in turn, driven by electric motor 24 through a belt system 26. The other end of belts 20 are connected to roller 28. Roller 28 forms the receiving end for the leading edge of the mats which are to be rolled. Roller 30 includes an outer rubber portion 32, which is adapted to make contact with the mat as it moves along belts 20. This rubber surface 32 ensures that the mats are gripped by this roller. The remainder of the device includes an upper and lower rolling section 34, which includes a plurality of curved stainless steel fingers 36 which alternate between the belts 20. These curved fingers act as guides to initiate the rolling action for the mat. Between each of fingers 36 are situated doughnut rollers 38. These doughnut rollers are on a common axle 40, as shown in FIG. 1. The doughnut rollers utilize a roughened outer rubber surface to make good gripping contact with the mat to assist in the rolling action. The tangential speed of the doughnut rollers is somewhat greater than the linear speed of belts 20.

Mounted above fingers 36 on rod 42 are a plurality of guide fingers 44 forming part of the upper rolling section. The rod and thus the guide fingers are biased inwardly by spring 46. Thus the guide fingers 44 will maintain a downward force on the roll as it accumulates layers and grows in thickness. Furthermore, by permitting the guide fingers to float, both very large and very small mats are able to be rolled without changing the setup of the machine. Mounted above the guide fingers 44 on either side of each finger is a plurality of belts 48. The belts 48 are mounted on the respective rollers 50 and 52. These rollers 50 and 52 as well as doughnut roller 38 are driven by belt 54 which, in turn, is driven by motor 24. These belts are mounted on a bracket which is attached to the frame of the machine and pivot about roller 52. The bracket is counterbalanced by a spring (not shown). The belts 48 bear down on the top of the mat as it comes through finger 36 with equal weight as the mat grows in diameter. The linear speed of belts 48 are somewhat greater than the linear speed of belts 20 in order, again, to assist in assuring a tight roll for the mat. The sectional view of rollers for belts 48 are shown only partially in FIG. 1 for exemplification purposes.

The machine described above operates as follows. A mat is introduced into the front end of the conveyor section 18 near roller 28. The leading edge passes under and makes contact with the rubber surface 32 of roller 30 and it contacts the lower portion of fingers 36 coming off belt 20. Fingers 36 cause the mat to begin to curve upwardly and doughnut roller 38 makes contact with the leading edge of the mat and with its tangential speed being somewhat greater than the speed of the conveyor belts 20, the mat will begin to form into a tight roll. Conveyor belts 48 and guide fingers 44 approximately at the same time make contact with the leading edge of the mat with the linear speed of belts 48, again, being somewhat faster than the belt speed 20 while the mat continues in the tight roll with the guide finger 44 finalizing the tightness of the roll inwardly by spring 46. As the roll size begins to grow with more and more layers, the spring biased guide fingers 44 will move upwardly as well as the conveyor belt 46. Thus a substantially tightly rolled mat is automatically and easily provided.

From the foregoing description of the preferred embodiment of this invention it will be apparent that many modifications may be made therein without departing from the true spirit and scope of this invention.

I claim:

1. An apparatus for rolling a flat flexible workpiece, having a leading edge, comprising:

a conveyor section; a rolling section including a lower portion; said conveyor section for transporting said workpiece at a predetermined linear speed in its flattened condition to said rolling section; said lower portion of said rolling section including a plurality of spaced apart curved first fingers; said plurality of curved first fingers located in a horizontal row adjacent one another; each of said curved first fingers having feed-in and feed-out portions located on opposing ends of said curved first fingers; said feed-in portions located adjacent one end of said conveyor section for receiving said workpiece from said conveyor section; said first fingers each substantially simultaneously adapted to contact the leading edge of said workpiece; a plurality of spaced apart rollers driven by a common drive means; said rollers located in a horizontal row adjacent one another; at least a portion of one of said rollers located between at least two adjacent curved first fingers and between said feed-in and feed-out portions of said adjacent first fingers; said rollers each substantially simultaneously adapted to contact the leading edge of said workpiece; said rollers having substantially non-skid outer surfaces to grip said workpiece; said rollers adapted to contact the workpiece to drive it along said first fingers for forming said flat workpiece into a rolled workpiece; an upper portion of said rolling section; said upper portion including a second plurality curved fingers detached from said first plurality of fingers but forming approximately a continuation of the arc of said first plurality of fingers, said second fingers biased inwardly toward said lower portion to insure a tight roll yet will move outwardly away from said lower portion as the circumference of the roll increases; said second fingers being in a horizontal row and being mounted on a common substrate so that said second fingers will all move in a simultaneous fashion; an open area between one end of said second fingers and said conveyor section; said open area being free from any curved fingers.

2. An apparatus as set forth in claim 1, wherein said rollers operate at a faster tangential speed than the linear speed of said conveyor section.

3. An apparatus as set forth in claim 1, wherein said common substrate is a rod, said rod being spring-biased.

4. An apparatus as set forth in claim 1, wherein the upper portion of said rolling section further includes a transport means adapted to contact the workpiece, said transport means being located between said first and second fingers and operating at a predetermined linear speed.

5. An apparatus as set forth in claim 4, wherein the linear speed of said transport means is greater than the linear speed of said conveyor means.

* * * * *